US011242720B2

(12) United States Patent
Santoso et al.

(10) Patent No.: US 11,242,720 B2
(45) Date of Patent: Feb. 8, 2022

(54) THREADLESS FLOAT EQUIPMENT AND METHOD

(71) Applicant: Halliburton Energy Services, Inc., Houston, TX (US)

(72) Inventors: Handoko Tirto Santoso, Houston, TX (US); Min Mark Yuan, Katy, TX (US); Stephen Allen Yeldell, Humble, TX (US); Frank Acosta, Spring, TX (US); Rajesh Parameshwaraiah, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 174 days.

(21) Appl. No.: 16/495,268

(22) PCT Filed: Dec. 6, 2018

(86) PCT No.: PCT/US2018/064166

§ 371 (c)(1),
(2) Date: Sep. 18, 2019

(87) PCT Pub. No.: WO2020/117234

PCT Pub. Date: Jun. 11, 2020

(65) Prior Publication Data

US 2021/0246746 A1 Aug. 12, 2021

(51) Int. Cl.
*E21B 23/06* (2006.01)
*E21B 17/042* (2006.01)

(52) U.S. Cl.
CPC ..... *E21B 23/06* (2013.01); *E21B 17/042* (2013.01)

(58) Field of Classification Search
CPC ..... E21B 23/06; E21B 17/042
See application file for complete search history.

(56) References Cited

U.S. PATENT DOCUMENTS

| | | | |
|---|---|---|---|
| 5,058,672 | A | 10/1991 | Cochran |
| 5,379,835 | A | 1/1995 | Streich |
| 6,497,291 | B1 | 12/2002 | Szarka |
| 2003/0226668 | A1 | 12/2003 | Zimmerman et al. |
| 2016/0024874 | A1 | 1/2016 | Johnson et al. |
| 2018/0266206 | A1 | 9/2018 | Berscheidt et al. |

OTHER PUBLICATIONS

International Search Report and Written Opinion issued in related PCT Application No. PCT/US2018/064166 dated Sep. 6, 2019, 13 pages.
International Preliminary Report on Patentability issued in related PCT Application No. PCT/US2018/064166 dated Jun. 17, 2021, 10 pages.

*Primary Examiner* — Taras P Bemko
(74) *Attorney, Agent, or Firm* — John Wustenberg; Baker Botts L.L.P.

(57) ABSTRACT

A packer assembly and valve assembly without special or custom threads are used to provide a threadless float assembly. A packer assembly with inserts disposed in slip wedges is set by applying compressive forces using a setting tool. A valve assembly may be positioned during setting of the packer assembly between a holder and a setting tool insert end or may be positioned abutting a spacer after setting of the packer assembly. A setting tool and a plunger along with a pump are used to apply compressive forces on the packer assembly to set the packer assembly without requiring that the packer assembly or the valve assembly have special threading as the inserts, holder and spacer maintain the components in a stationary position.

15 Claims, 8 Drawing Sheets

THREADLESS FLOAT EQUIPMENT AND METHOD

CROSS-REFERENCE TO RELATED APPLICATION

The present application is a U.S. National Stage Application of International Application No. PCT/US2018/064166 filed Dec. 6, 2018, which is incorporated herein by reference in its entirety for all purposes.

TECHNICAL BACKGROUND OF THE INVENTION

The present invention relates generally to threadless float assemblies and in particular to threadless float assemblies for use in one or more downhole operations.

BACKGROUND

This section is intended to provide relevant background information to facilitate a better understanding of the various aspects of the described embodiments. Accordingly, it should be understood that these statements are to be read in this light and not as admissions of prior art.

Float equipment is generally used in the lower section of a wellbore during a downhole operation, for example, a hydrocarbon recovery operation. Typically, float equipment includes a float collar and either a guide shoe or a float shoe with the float collar coupled to the guide or float shoe either directly or spaced apart by one or more joints. The float collar and guide or float shoe are each threaded so that each can be coupled together or to other sections or joints. These threads may be expensive and time-consuming to manufacture on the float collar and guide or float shoe. For example, an operation may require that the float equipment couple to a specific equipment at a well site, such as a specific downhole tool, casing segment or section, joint or piping and thus the threads of the float collar and guide or float shoe must be manufactured according to corresponding threads of the specific equipment. This type of custom manufacturing for each operation increases costs and the time required to complete the operation. Thus, a need exists for float equipment that does not require custom threads for coupling to specific equipment.

BRIEF DESCRIPTION OF THE DRAWINGS

Embodiments of the invention are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
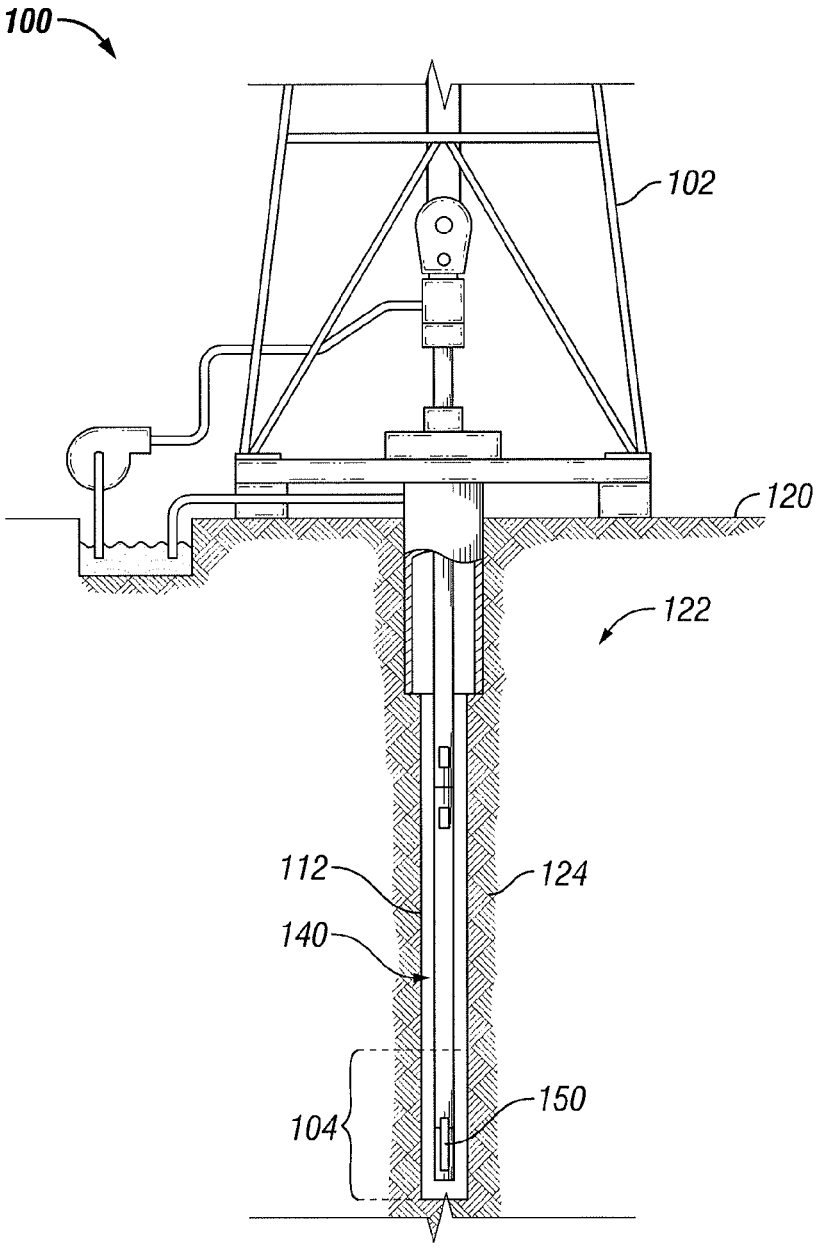
FIG. 1 depicts a schematic view of a well system including a threadless float assembly located within a casing in a downhole environment, according to one or more aspects of the present disclosure.

Float equipment is generally used in the lower section of a wellbore for one or more downhole operations. For example, float equipment may be used during disposition and cementing of casing in a wellbore. Float equipment must be positioned or disposed within casing segments or sections associated with a particular well site. Each well site may require float equipment that accommodates one or more criteria of specific equipment, for example, casing segment or section or a downhole tool. For example, the one or more criteria may comprise casing weight, wellbore diameter, thread design, any other criteria or combination thereof. Each well site may require different criteria for any one or more other well sites. Thus, the float equipment for a specific or particular wellbore at a well site may require custom threads. Threading float equipment to accommodate the specific criteria of a well site, wellbore or equipment may increase costs as each well site or even each wellbore at the same well site may require different threading for the float equipment and may increase the time required to complete the operation as preparing the float equipment with the proper threads may take several weeks.

The present invention relates generally to float equipment, and in particular to a threadless float assembly for use in a downhole operation at a site, for example, a hydrocarbon exploration and recovery site. In one or more embodiments, a threadless float assembly is set in a casing section or segment without requiring threading of any component of the threadless float assembly with custom threads for mating to equipment at the site. For example, a packer assembly can be set using a setting tool that actuates a packer element where a lock ring, a spacer, a shear pin or any combination thereof holds a valve in place without requiring special threading to dispose and set the threadless float assembly in a casing segment or section. Casing segments or sections are generally standardized and can easily be mated with one or more other casing segments or sections at the site. As the threadless float assembly is disposed and set inside such a casing segment or section, no custom threading is required for installation of the threadless float assembly at the site.

As the requirement of special threads is eliminated, the delivery time of a threadless float assembly to a specific well site is decreased which decreases the time to complete the required operation. Costs may also be reduced as the threadless float assembly no longer requires the manufacturing of special threads. Additionally, the need for specialized personnel and equipment to mate the threadless float assembly to the specific equipment at the particular well site or wellbore is eliminated. The one or more embodiments discussed herein provide a threadless float assembly that does not require custom threads for use at a particular well site or wellbore without requiring that the threadless float assembly meet the specific thread criteria for the equipment used at a particular wellbore.

FIG. 1 depicts a schematic view of a well system 100 at a well site. Well system 100 comprises a rig 102 disposed or positioned above a wellbore 112 that is formed in a subterranean formation 122 below a surface 120. A casing 140 is disposed or positioned in the wellbore 112. A threadless float assembly 150 is disposed or positioned in a casing section or segment 104 of casing 140. In one or more embodiments, the threadless float assembly 150 is disposed or positioned in a casing section or segment 104 at the surface 120. Casing 140 may comprise one or more casing sections or segments 104 coupled together. In one or more embodiments, threadless float assembly 150 may be disposed or positioned in a bottommost or distal casing segment or section 104 or any other casing segment or section 104.

While the well system 100 of the present disclosure illustrates a land-based well system, the present disclosure contemplates any well system, such as an offshore or subsea well or a on shore or land well. Further, it will be understood that the present disclosure is not limited to only a hydrocarbon well system, such as natural gas or oil well. The present disclosure also encompasses wellbores in general, for example, for water. Further, the present disclosure may be used for the exploration and formation of geothermal wellbores intended to provide a source of heat energy instead of hydrocarbons.

While FIG. 1 illustrates a substantially vertical wellbore 112, the threadless float assembly 150 may also be implemented in other wellbore orientations. For example, the threadless float assembly 150 may be adapted for horizontal wellbores, slant wellbores, curved wellbores, vertical wellbores, or any combination thereof. The threadless float assembly 150 of FIG. 1 may comprise any one or more embodiments discussed herein.

Figure 2A:
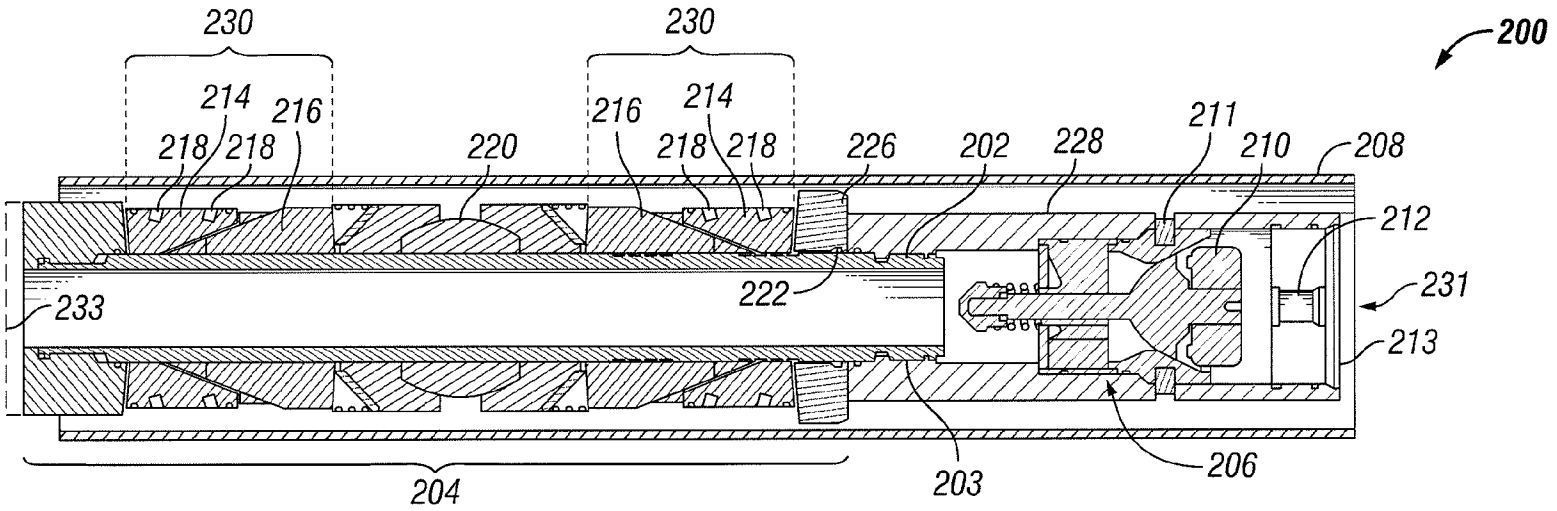
FIG. 2A is a cross-sectional view of a threadless float assembly in an unset position, according to one or more aspects of the present disclosure.

FIG. 2A illustrates a cross-sectional view of a threadless float assembly 200 in an unset position accordingly to one or more aspects of the present disclosure. The threadless float assembly 200 is disposed or positioned within a casing section or segment 208. In one or more embodiments, threadless float assembly 200 is the same as or similar to threadless float assembly 150 and casing section or segment 208 is the same as or similar to casing section or segment 104 of FIG. 1. A mandrel 202 is disposed or positioned within the casing section or segment 208. In one or more embodiments, the mandrel 202 comprises a metal.

A packer assembly 204 is disposed or positioned circumferentially about the mandrel 202. The packer assembly 204 may be selected based on one or more factors or criteria for a particular operation, well site, wellbore or any combination thereof including, but not limited to, casing weight, casing size, temperature of the wellbore at a disposition depth, or any other factor. The packer assembly 204 comprises one or more slip wedge pairs 230, expandable packer element 220, stopper or wedge 226 and lock ring 222. In one or more embodiments, slip wedge pairs 230 are disposed or positioned about, adjacent to, to abut or to couple to a packer element 220, for example, at each end of the packer assembly 204. For example, a first slip wedge pair 230 may be disposed or positioned at a first end of the packer assembly 204 (for example, towards an end cap 233 at a second end of the casing segment or section 208) while a second slip wedge pair 230 may be disposed or position at a second end of the packer assembly 204 (for example, towards an aperture 231 at a first end of the casing segment or section 208) of the threadless float assembly 200 such that the packer element 220 is in between the first slip wedge pair 230 and the second slip wedge pair 230. In one or more embodiments, only a single slip wedge pair 230 may be disposed or positioned at a single end of the packer assembly 204. While slip wedge pairs 230 are illustrated as wedges or triangular shape, in one or more embodiments the slip wedge pairs 230 may be any suitable shape.

An expandable packer element 220 is disposed or positioned between a first slip wedge pair 230 and a second slip wedge pair 230. The expandable packer element 220 expands to contact or engage with the inner surface 209 of the casing segment or section 208. Slip wedge pair 230 comprises an upper slip wedge 214 and a lower slip wedge 216. The upper slip wedge 214 is slidably coupled to the lower slip wedge 216. One or more inserts 218 are molded, formed or disposed on or into upper slip wedge 214. In one or more embodiments, inserts 218 may comprises buttons, teeth, cleats, any other engagement device or combination thereof. Inserts 218 may be positioned at an angle with respect to a central axis of the packer assembly 204. A portion or edge of the inserts 218 protrudes from the corresponding upper slip wedge 214 so that as the upper slip wedge 214 slides up or is forced over the lower slip wedge 216, the inserts 218 engage an inner surface 209 of the casing segment or section 208 to maintain the expandable packer element 204 in a stationary or set position.

A stopper or wedge 226 is disposed or positioned about, couples to or engages with a slip wedge pair 230 (for example, the slip wedge pair 230 towards the aperture 231 of a first end of the casing segment or section 208) and a valve assembly 206. A lock ring 222 is disposed circumferentially about the mandrel 202 proximate to the stopper or wedge 226 or between the stopper or wedge 226 and the mandrel 202. A stopper or wedge 226 engages the lock ring 222 to secure the mandrel 202 when the packer assembly 204 is in a set position.

As illustrated in FIG. 2A, a valve assembly 206 may be disposed in a casing segment or section 208 between a mandrel 202 and a first end of the casing segment or section 208. A valve assembly 206 comprises a valve 210, one or more valve fasteners 211 and a setting tool receptacle 213 of a valve housing or outer surface 228. In one or more embodiments, a plunger receptacle 212 may be part of the valve assembly 206 or may be separate from the valve assembly 206. In one or more embodiments, the plunger receptacle 212 is removable. The valve 210 is disposed within a valve housing or outer surface 228 of the valve assembly 206. The one or more valve fasteners 211 couple or otherwise secure the valve 210 to the valve housing or outer surface 228. In one or more embodiments, fasteners 211 may be set screws, pins, threads or any other fastener that couples or engages the valve 210 to the valve 228. In one or more embodiments, the valve assembly 206 may be threadedly coupled, welded, adhesively coupled (for example, glued) or otherwise fastened or secured to the mandrel 202. For example, the mandrel 202 may comprise one or more threads 203 to mate the valve assembly 206 with the mandrel 202.

Figure 2B:
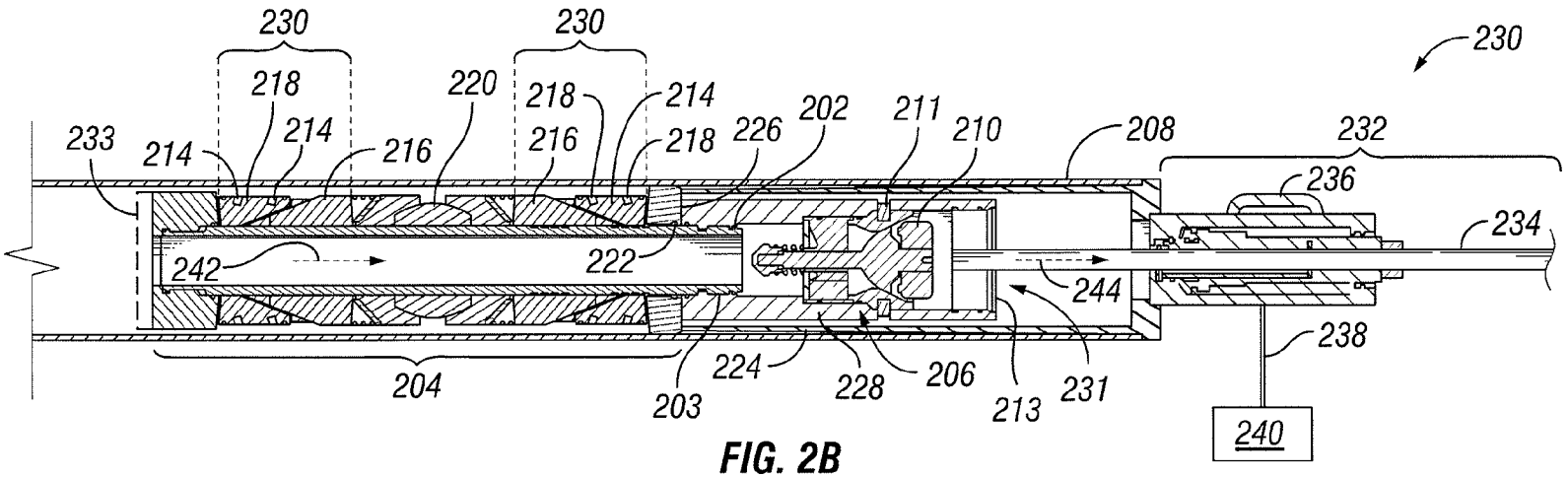
FIG. 2B is a cross-sectional view of a threadless float assembly in an unset position with a setting tool, according to one or more aspects of the present disclosure.

FIG. 2B is a cross-sectional view of a threadless float assembly 200 in an unset position with a setting tool 232 disposed or positioned in the setting tool receptacle 213, according to one or more aspects of the present disclosure. A removable holder 224 is disposed about the valve assembly 206 and abuts, couples to or engages stopper or wedge 226. Removable holder 224 may be installed by sliding the removable holder 224 over the valve housing or outer housing 228. Removable holder 224 stops or prevents displacement of the packer assembly 204 during setting of the packer assembly 204. The removable holder 224 is removed after setting the packer assembly 204. The setting tool 232 comprises a linear actuator 236. A plunger 234 is inserted through the linear actuator 236 to couple to or engage the valve assembly 206. The setting tool 232 couples to the threadless float assembly 200, for example, by coupling the linear actuator 236 to the setting tool receptacle 213 with the plunger disposed or positioned through the plunger receptacle 212. The linear actuator 236 couples to a pump 240 via a hose 238. The linear actuator 236 is actuated by the pump 240. Actuation of the pump 240 pulses the plunger 234 as indicated by arrows 242 and 244. In one or more embodiments, the linear actuator 236 is actuated electrically, hydraulically or both. Actuation of the linear actuator 236 and translational motion of the plunger 234 compresses the packer assembly 204 to set the packer assembly 204.

During compression, the removable holder 224 remains stationary and acts as a stopper for the packer assembly 204. The mandrel 202 moves with the plunger 234. The removable holder 224 prevents the packer assembly 204 from being displaced when the mandrel 202 is moved with the plunger 234 during actuation of the linear actuator 236. The removable holder 224 acts as the end point for the compression. The removable holder 224 comprises one or more portions or flanges that couple to or engage with the casing section or segment 208 to maintain the position of or hold in place the removable holder 224. As the packer assembly 204 compresses, the upper slip wedge 214 slides up the lower slip wedge 216, the one or more inserts 218 are extendable to engage or couple to an inner surface 209 of the casing section or segment 208 to secure the packer assembly 204 to the casing section or segment 208. In one or more embodiments, the one or more inserts 218 may comprise ceramic, metal, metal carbide, thermoplastic, fiberglass, any other material harder than the casing section or segment 204, or any combination thereof. The stopper or wedge 226 is also compressed during actuation of the linear actuator 236. Once the stopper or wedge 226 reaches a certain compression point, the lock ring 222 engages the stopper or wedge 226 to prevent the mandrel from being displaced or from moving once the packer assembly 204 is in a set position.

Figure 2C:
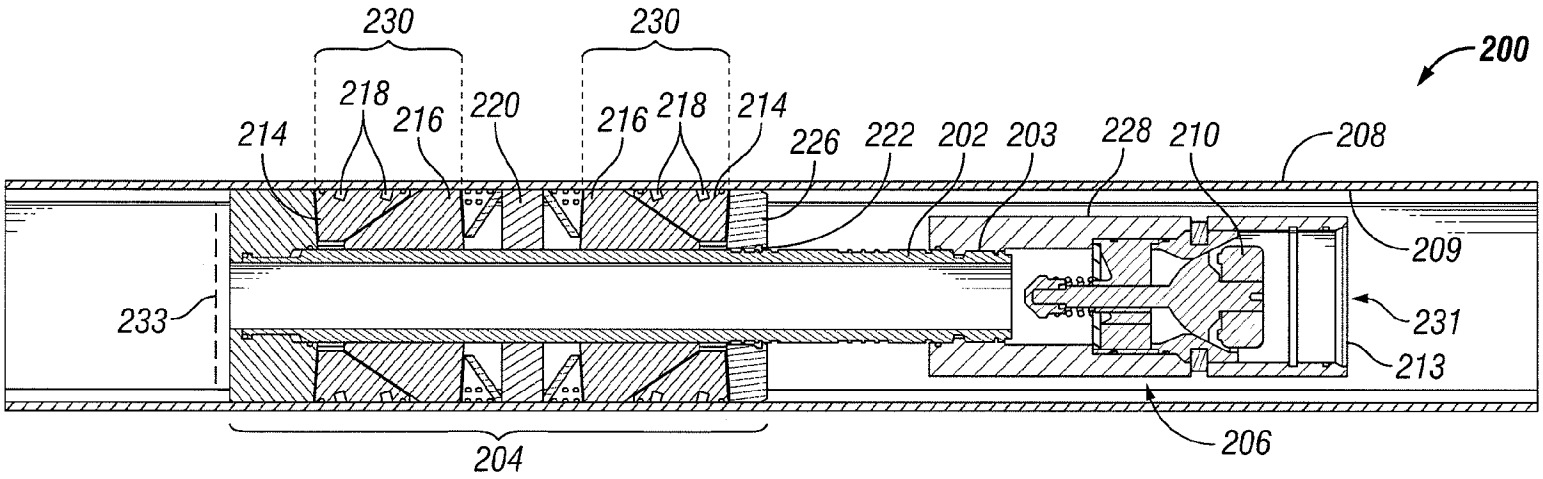
FIG. 2C is a cross-sectional view of a threadless float assembly in a set position, according to one or more aspects of the present disclosure.

FIG. 2C is a cross-sectional view of a threadless float assembly 200 in a set position. Once the packer assembly 204 is set, the setting tool 232, including the plunger 234 and the linear actuator 236, and the removable holder 224 are removed. In the set position, the packer assembly 204 holds the pressure from both directions or pressure at either side of the packer assembly 204. As illustrated in FIG. 2C, the threadless float assembly 200 in a set position is ready to be coupled to additional casing segments or sections without requiring any additional threading as the casing segment or section 208 couples to threads of one or more other casing segments or sections, for example, one or more other casing segments or sections at a well site.

Figure 3A:
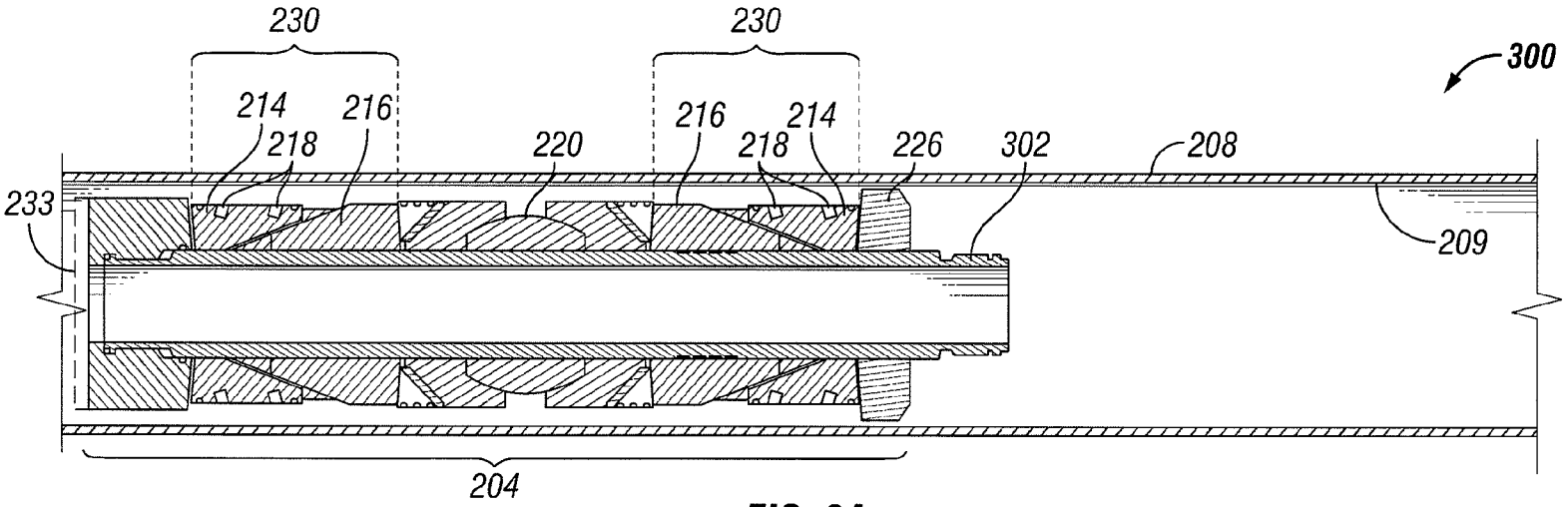
FIG. 3A is a cross-sectional view of a threadless float assembly in an unset position, according to one or more aspects of the present disclosure.

FIG. 3A is a cross-sectional view of a threadless float assembly 300 in an unset position, according to one or more aspects of the present disclosure. Threadless float assembly 300 is similar to the threadless float assembly 200 in FIGS. 2A-C except that threadless float assembly 300 does not require a lock ring, for example, one or more lock rings 222 of FIGS. 2A-2C and a valve assembly is installed after setting of the packer assembly. Mandrel 302 is similar to mandrel 202, however, for example, mandrel 302 does not comprise one or more lock rings 222.

Figure 3B:
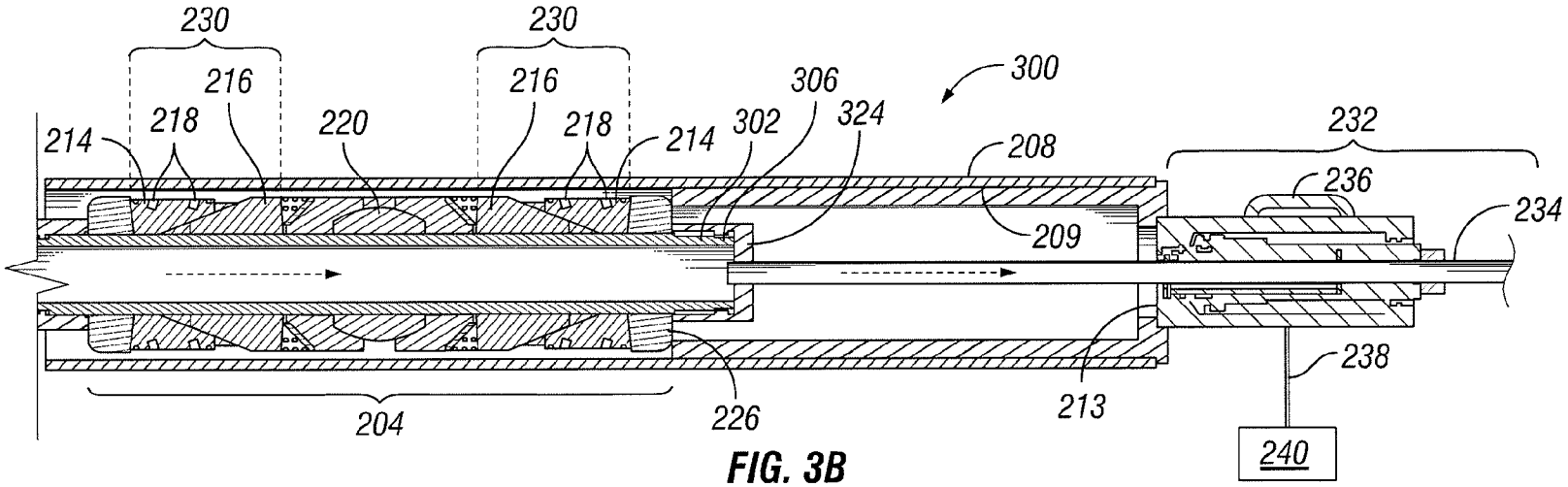
FIG. 3B is a cross-sectional view of a threadless float assembly in an unset position with a setting tool, according to one or more aspects of the present disclosure.

FIG. 3B illustrates a threadless float assembly 300 in an unset position with a setting tool 232 disposed or positioned in the setting tool receptacle 213, according to one or more aspects of the present disclosure. The setting tool 232 couples to the threadless float assembly 300, for example, by coupling the linear actuator 236 to the setting tool receptacle 213. The linear actuator 236, pump 240 and plunger 234 operate as discussed with respect to FIGS. 2A-2C. As threadless float assembly 300 does not comprise a lock ring as discussed above with respect to FIGS. 2A-2C, the mandrel 302 floats within the casing segment or section 208. In one or more embodiments, a fastener 306 couples the mandrel 302 to the removable holder 324 to prevent the mandrel 302 from floating freely within the threadless float assembly 300. The fastener 306 may comprise a screw, shear pin or any other fastener. A removable holder 324 maintains the stopper or wedge 226 in place so that the appropriate compression can be applied to the packer assembly 204. Once the packer assembly 204 is set, the removable holder is removed from the casing segment or section 208.

Figure 3C:
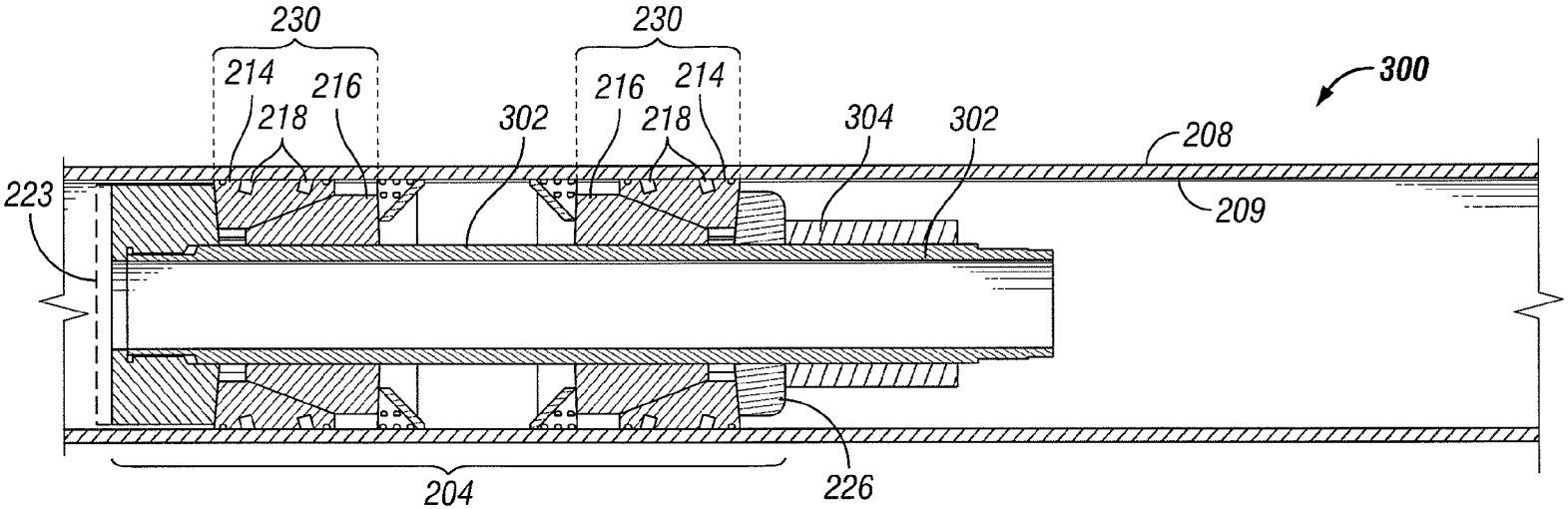
FIG. 3C is a cross-sectional view of a threadless float assembly in a set position, according to one or more aspects of the present disclosure.

FIG. 3C illustrates a cross-sectional view of a threadless float assembly 300 in a set position with a spacer 304. Once the threadless float assembly 300 is positioned or disposed downhole, the movement of the floating mandrel 202 may cause damage or prevent the threadless float assembly 300 from functioning properly. In one or more embodiments, a spacer 304 may be used to further limit the translation movement of the mandrel 302. A spacer 304 may be disposed or positioned in the casing segment or section 208 circumferentially about the mandrel 302 between the packer assembly and a first end of the casing segment or section 208. The spacer 304 may couple to or engage the stopper or wedge 226 or the packer assembly 204. The spacer 304 holds or prevents displacement of the set packer assembly 204 and prevents the mandrel 302 from floating within the casing segment or section 208. In one or more embodiments, a plurality of spacers 304 may be disposed or positioned circumferentially about the mandrel 302.

Figure 3D:
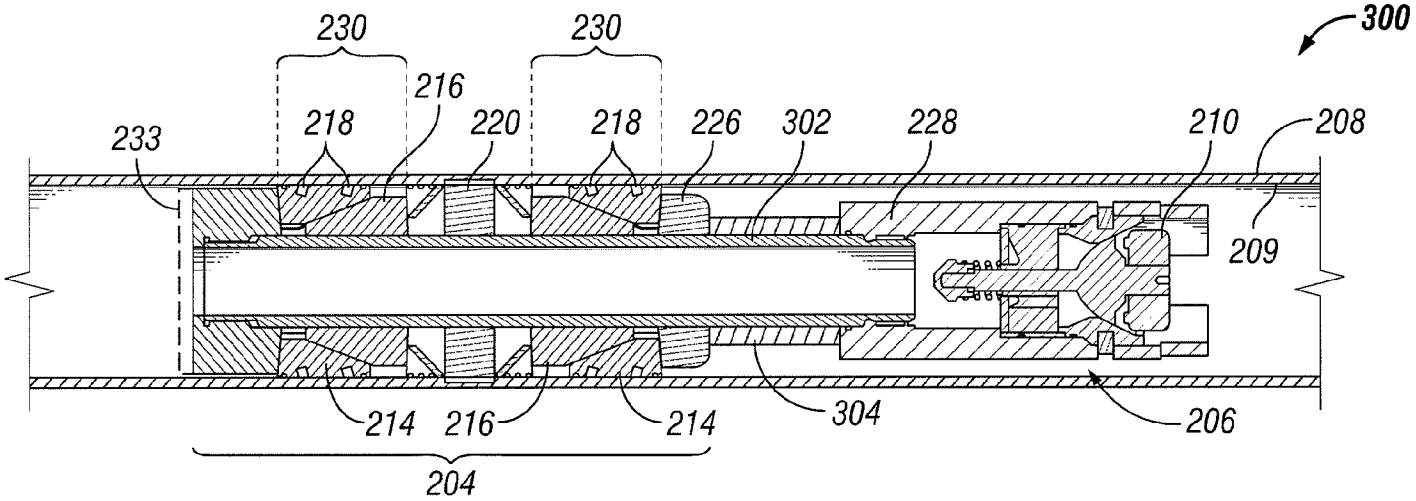
FIG. 3D is a cross-sectional view of a threadless float assembly in a set position with a valve assembly, according to one or more aspects of the present disclosure.

FIG. 3D illustrates a cross-sectional view of a threadless float assembly 300 in a set position with a valve assembly 206. Once the packer assembly 204 is set as illustrated in FIGS. 3B-3C, the valve assembly 206 is coupled to the mandrel 202 between the spacer 304 and a first end of the casing segment or section 208. For example, the spacer 304 is between the packer assembly 204 and the valve assembly 206. In one or more embodiments, the valve assembly 206 couples, engages with, abuts or is otherwise adjacent to the spacer 304. The valve assembly 206 may be coupled to the mandrel 202 as discussed above with respect to FIGS.

2A-2C. The threadless float assembly 300 as illustrated in FIG. 3D may be mated, threaded or otherwise coupled to one or more other casing segments or sections, for example, one or more other casing segments or sections at a well site.

Figure 4:
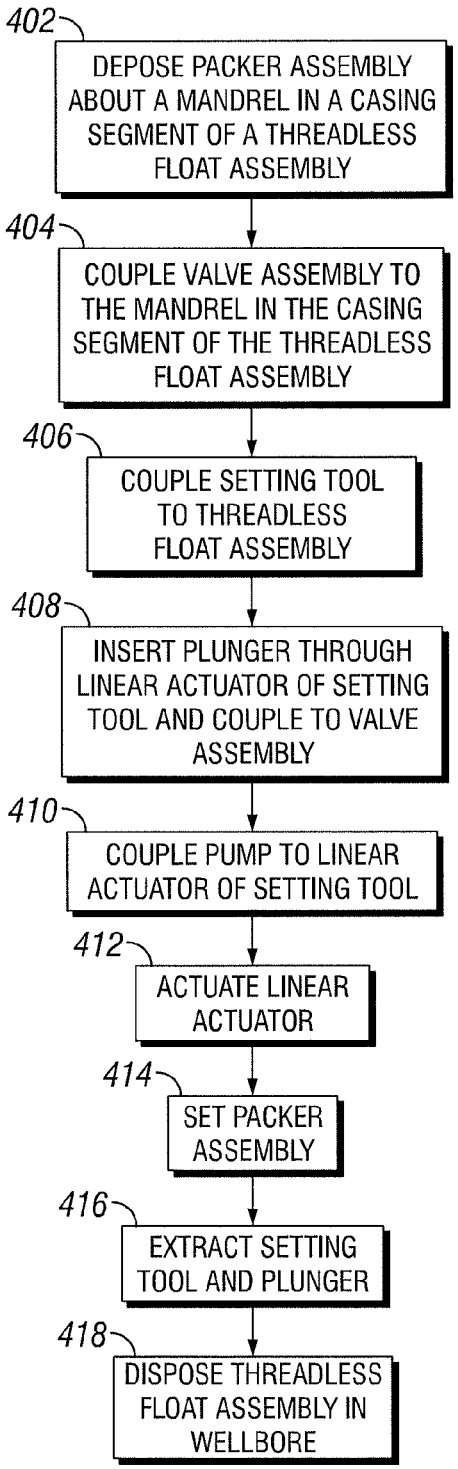
FIG. 4 illustrates a flowchart for setting a threadless float assembly, according to one or more aspects of the present disclosure.

FIG. 4 illustrates a flowchart for setting a threadless float assembly, for example, threadless float assembly 200 of FIGS. 2A-2C, according to one or more aspects of the present disclosure. At step 402, a packer assembly 204 is disposed or positioned about a mandrel disposed or positioned in a casing segment or section 208. The casing segment or section 208 is selected based on the casing segments or sections required for an operation for a well system at a well site, for example, well system 100 of FIG. 1.

At step 404, a valve assembly 206 is coupled to the mandrel 202 in the casing segment or section 208. In one or more embodiments, the valve assembly 206 may be threadedly coupled, welded, adhesively coupled (for example, glued) or otherwise fastened or secured to the mandrel 202. For example, in one or more embodiments, the valve assembly 206 may be coupled to the mandrel 202 as discussed with respect to FIG. 2A, 6A or 7A.

Figure 6A:
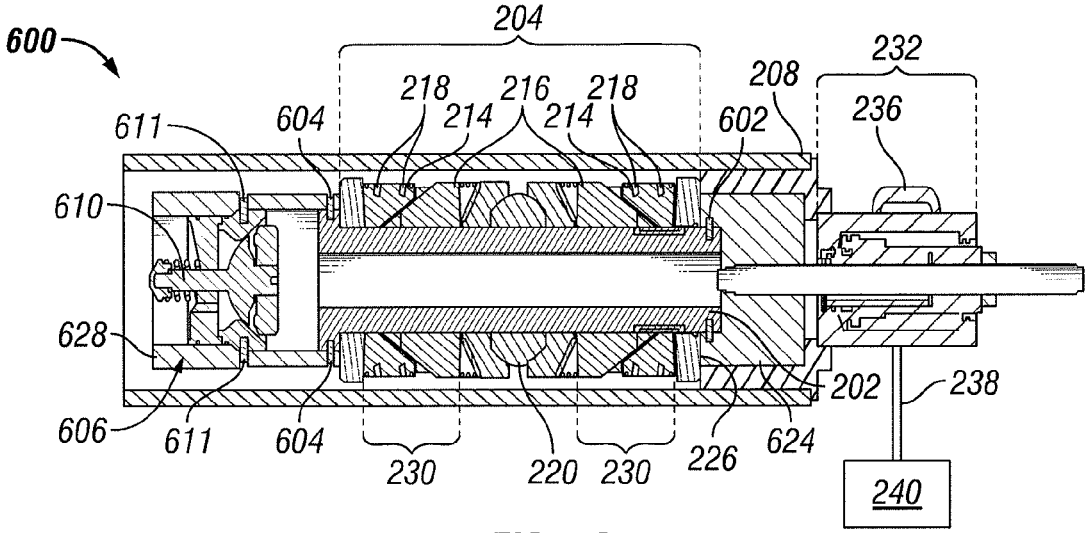
FIG. 6A illustrates a cross-sectional view of a threadless float assembly in an unset position, according to one or more aspects of the present disclosure.

Prior to setting the packer assembly 204, the packer assembly 204 and the valve assembly 206 are not secured within the casing segment or section 208. A removable holder 224 may be disposed over the valve assembly 206 between the casing segment or section 208 and the valve assembly 206, for example, as illustrated in FIG. 2B. At step 406, a setting tool 232 is coupled to a setting tool receptacle 213 of the valve assembly 206 within the casing segment or section 204. At step 408, a plunger 234 is inserted through the linear actuator 236 of the setting tool 232 and is coupled to the valve assembly 206. In one or more other embodiments, the setting tool 232 including plunger 234 and linear actuator 236 may be disposed as discussed with respect to FIGS. 6A-6C and 7A-7D. In one or more embodiments, the removable holder 224 is disposed as illustrated in FIGS. 6A and 7A.

At step 410, a pump 240 is coupled to the linear actuator 236 of the setting tool 232, for example, via a hose 238. The pump 240 actuates the linear actuator 236 at step 412. Actuation of the linear actuator 236 causes the plunger to reciprocate within the valve assembly 236. The removable holder 224 maintains the packer assembly 204 stationary when the mandrel 202 and the plunger 234 are pulled during actuation of the linear actuator 236. The pump 240 may be an electric or hydraulic pump. During actuation of the linear actuator 236, the plunger 234 is pulled along with the mandrel 202 to apply a compressive force on the packer assembly 204.

At step 414, the packer assembly 204 is set or transitioned to a set position by compressive forces. The compressive forces due to actuation of the linear actuator 236 cause the upper slip wedge 214 to slide up the lower slip wedge 216 such that the inserts 218 are forced to extend such that the inserts 218 engage or couple to an inner surface 209 of the casing segment or section 208. The compressive forces also cause the expandable packer element 220 to expand to contact or engage an inner surface 209 of the casing segment or section 208 to create a seal. The compressive forces further cause the packer assembly 204 to compress against the stopper or wedge 226 causing the stopper or wedge 226 to engage or lock with or couple to the lock ring 222.

At step 416, the setting tool 232 and plunger 234 are extracted or removed from the threadless float assembly 200. In one or more embodiments, the setting tool 232 may be extracted or removed as discussed with respect to FIGS. 6A, 6B, 7A and 7B. At step 418, the threadless float assembly 200, now in the set position, is disposed or positioned within a wellbore, for example, wellbore 112 of FIG. 1. For example, the threadless float assembly 200 may be set at a well site or may be set at a remote location and transported or otherwise conveyed to the well site. As the threadless float assembly 200 is set without requiring special or custom threading, the threadless float assembly 200 may be promptly threaded with or otherwise coupled to one or more casing segments or sections at the well site.

Figure 5:
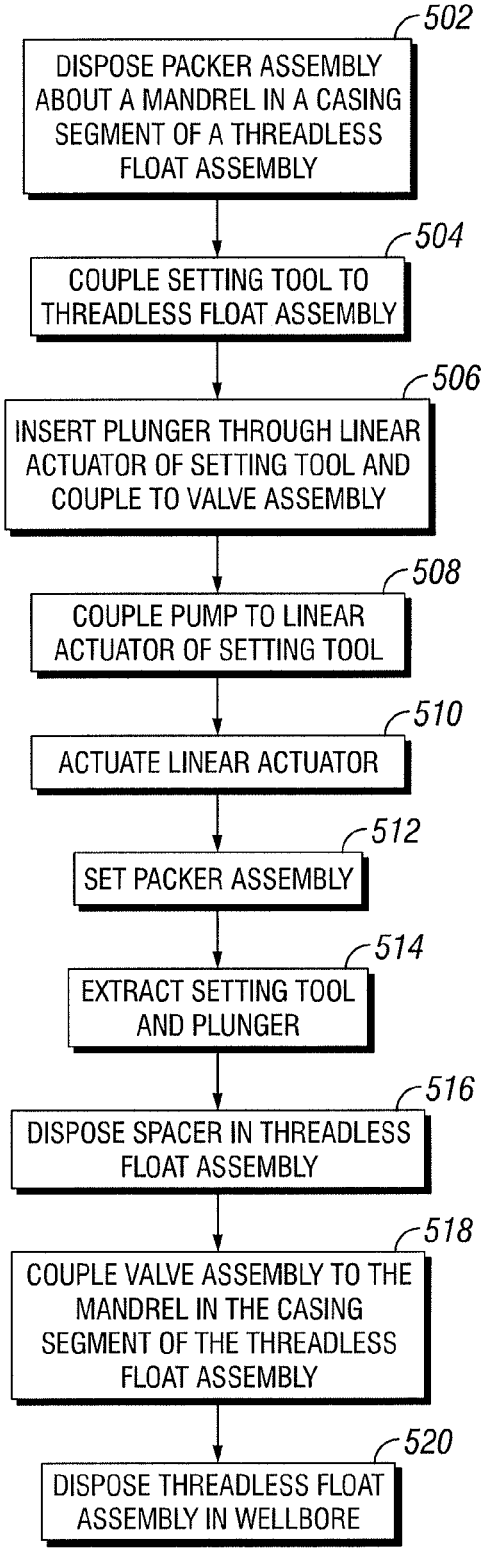
FIG. 5 illustrates a flow chart for setting a threadless float assembly, according to one or more aspects of the present disclosure.

FIG. 5 illustrates a flow chart for setting a threadless float assembly, for example, threadless float assembly 300 of FIGS. 3A-3D, according to one or more aspects of the present disclosure. At step 502, a packer assembly 204 is disposed or positioned about a mandrel 202 in a casing segment or section 208 similar to or the same as discussed with respect to step 402 of FIG. 4. At step 504, a setting tool is coupled to the setting tool receptacle 213 of the threadless float assembly 300. At step 506, the plunger 234 is inserted through the linear actuator 236 of the setting tool 232 and coupled to mandrel 202 by using a thread or shear pin, for example, shear pin 602 of FIGS. 6A-6D. At step 508, a pump 240 is coupled to the linear actuator 236 of the setting tool 232 similar to or the same as discussed with respect to step 410 of FIG. 4.

At step 510, the linear actuator 236 is actuated by the pump 240 similar to or the same as discussed with respect to step 412 of FIG. 4. At step 512, the packer assembly 204 is set similar to the step 414 of FIG. 4 except that a lock ring is not utilized. Rather, once the packer assembly 204 has been compressed such that the inserts 218 have engaged the inner surface 209 of the casing segment or section 208 and the expandable packer element 220 has expanded, one or more spacers 306 are disposed or positioned about the mandrel 202 in the casing segment or section 208 between the stopper or wedge 226 and a valve assembly 206 that is coupled to the mandrel 202 at step 518. The spacers 306 maintain the packer assembly 204 and the mandrel 202 in a stationary or substantially stationary position during an operation at the well site. In one or more embodiments, the valve assembly 206 is threadedly coupled, welded, adhesively coupled (for example, glued) or otherwise fastened or secured to the mandrel 202.

At step 520, the threadless float assembly is disposed or positioned in a wellbore similar to or the same as discussed with respect to step 418 of FIG. 4.

FIG. 6A illustrates a cross-sectional view of a threadless float assembly 600 with a setting tool 232 in an unset position, according to one or more aspects of the present disclosure. Threadless float assembly 600 is similar to threadless float assembly 200 of FIG. 2A and threadless float assembly 300 of FIG. 3A. Threadless float assembly 600 comprises one or more holder fasteners 602 that couple the holder 624 to the mandrel 202. The one or more holder fasteners 602 may be disposed at any one or more locations circumferentially about the removable holder 224 and the mandrel 202. In one or more embodiments, the one or more holder fasteners 602 are disposed ninety degrees apart or at any other angular separation. The one or more holder fasteners 602 are shearable, for example, comprise one or more shear pins, where the shear value of the one or more holder fasteners 602 is the same as or substantially the same as the setting value of the packer assembly 204. The one or more holder fasteners 602 couple the holder 624 to the mandrel 202. The removable holder 624 is similar to the removable holder 224 of FIG. 2A.

A valve assembly 606 is disposed at second end of the casing segment or section 208. One or more valve fasteners 611 couple or otherwise secure the valve assembly 606 to the valve housing or outer surface 628. The valve assembly 606 may similar to the valve assembly 206 of FIG. 2A. One or more mandrel fasteners 604 couple the valve assembly 606 to the mandrel 202 proximate to the packer assembly 204. The packer assembly 204 is disposed about the mandrel 202 between the valve assembly 606 and a first end of the casing section or segment 208. The one or more valve fasteners 611 and the one or more mandrel fasteners 604 may comprise one or more of one or more set screws, one or more pins or any one or more other securing devices. In one or more embodiments, the mandrel 202 comprises a composite material, a metal material, or both. The one or more mandrel fasteners 604 may comprise a set screw or pin. In one or more embodiments, the one or more mandrel fasteners 604 are set screws and the mandrel 202 comprises a composite material. In one or more embodiments, the mandrel 202 comprises a metal material and includes one or more threads to mate the mandrel 202 with the valve assembly 606, for example, one or more threads 203 as illustrated in FIG. 2A. The linear actuator 236 couples to the removable holder 624. A plunger 234 is disposed through the linear actuator 236 and removable holder 624 to an interior of the threadless float assembly 600.

In one or more embodiments, the valve assembly 606, the packer assembly 204, the mandrel 202, the removable holder 624, the linear actuator 236 and plunger 234 couple together prior to being disposed or positioned within a casing segment or section 208. The threadless float assembly 600 may be assembled faster than other float assemblies as no threading is required.

Figure 6B:
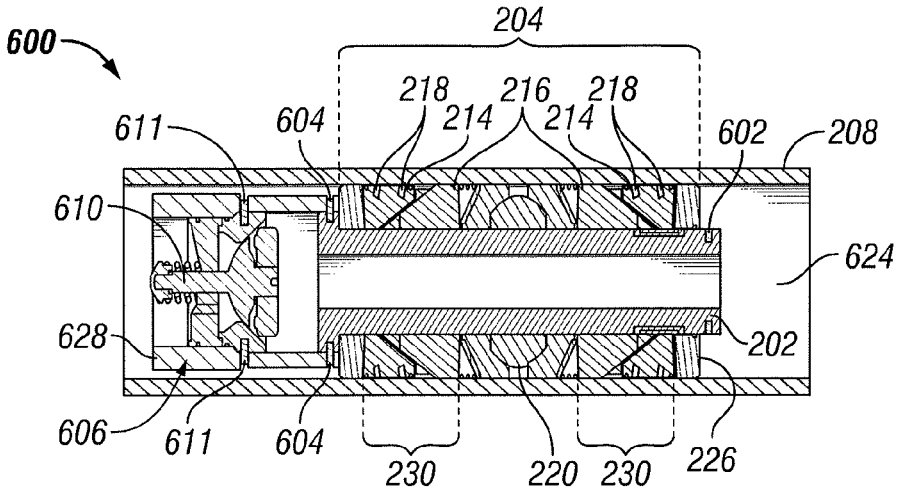
FIG. 6B illustrates a cross-sectional view of a threadless float assembly in a set position, according to one or more aspects of the present disclosure.
Figure 7A:
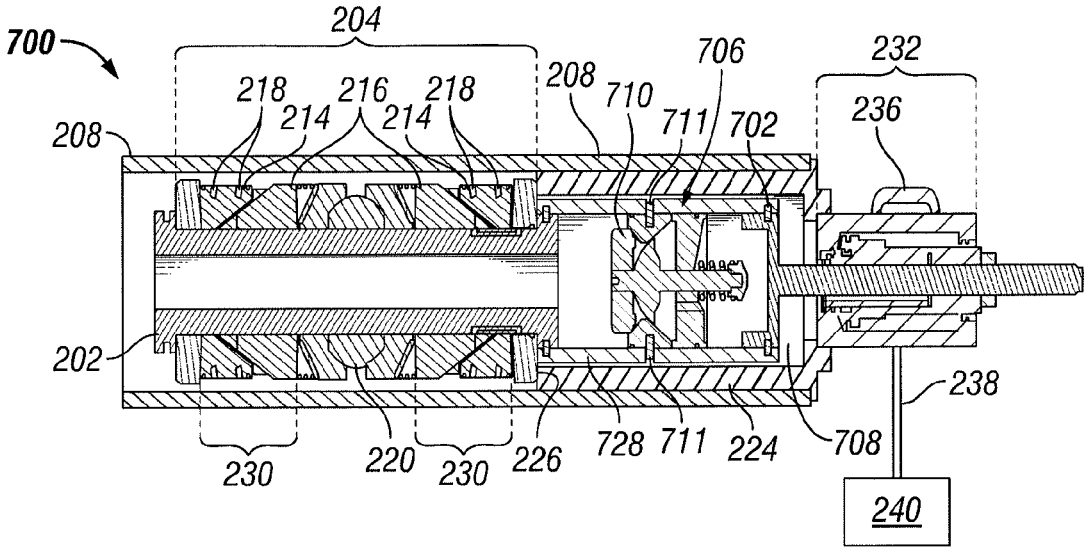
FIG. 7A illustrates a cross-sectional view of a threadless float assembly in an unset position, according to one or more aspects of the present disclosure.

FIG. 6B illustrates a threadless float assembly 600 in a set position, according to one or more aspects of the present disclosure. The packer assembly 204 of FIG. 6A is set similar to the packer assembly 204 of FIG. 2C. When the setting pressure for the packer assembly 204 is reached, the one or more holder fasteners 602 may shear. The shearing of the one or more holder fasteners 602 releases or allows for removal of the removable holder 624, plunger 234 and linear actuator 236 from the casing segment or section 208. The threadless float assembly 600 in the set position as illustrated in FIG. 6B may be coupled to one or more other casing segment or sections 208 without requiring special threading to dispose the valve assembly 606 and set the packer assembly 204 within the casing segment or section 208.

FIG. 7A illustrates a threadless float assembly 700 in an unset position, according to one or more aspects of the present invention. Threadless float assembly 700 is similar to threadless float assembly 600 except that the valve assembly 706 is coupled to the mandrel 202 and disposed within a removable holder 724. Removable holder 724 is similar to removable holder 224 of FIG. 2A. One or more holder fasteners 702 are similar to one or more holder fasteners 602 except the one or more holder fasteners 702 couple the removable holder 724 to the valve assembly 706. One or more valve fasteners 711 couple or otherwise secure the valve 710 to the valve housing or outer surface 728. The one or more mandrel fasteners 704 couple the mandrel 202 to the valve assembly 706 similar to the one or more mandrel fasteners 604 of FIG. 6A. As the threadless float assembly 700 comprises the one or more mandrel fasteners 704 and the one or more holder fasteners 702, mandrel 202 may comprise a composite material similar to FIG. 6A.

Figure 7B:
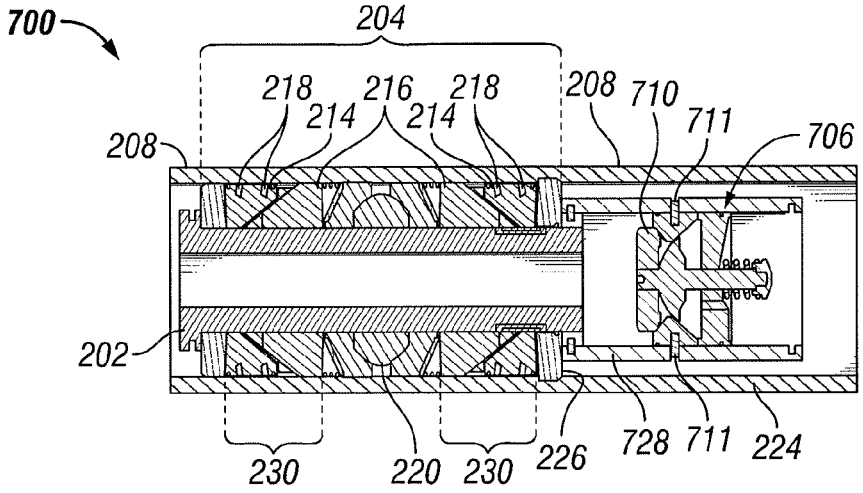
FIG. 7B illustrates a cross-sectional view of a threadless float assembly in a set position, according to one or more aspects of the present disclosure.

FIG. 7B illustrates a threadless packer assembly 700 in a set position, according to one or more aspects of the present disclosure. The packer assembly 204 of FIG. 7A is set similarly to the packer assembly 204 of FIG. 2C. Similar to FIGS. 6A and 6B, the one or more holder fasteners 702 are sheared when the packer assembly 204 is set. The shearing of the one or more holder fasteners 702 releases or allows for removal of the removable holder 724, plunger 234 and linear actuator 236 from the casing segment or section 208. The threadless float assembly 700 in the set position as illustrated in FIG. 7B may be coupled to one or more other casing segment or sections 208 without requiring special threading to dispose the valve assembly 706 and set the packer assembly 204 within the casing segment or section 208.

In one or more embodiments discussed above, any one or more threadless float assemblies may be configured such that one or more attachments may be coupled to the casing segment of section of the threadless float assembly. The one or more attachments may comprise one or more float valves, a plug landing seat, a guide nose, any other attachment, or any combination thereof. In one or more embodiments, the one or more attachments may be coupled to the threadless float assembly using a threading, a welding, an adhesive, or any combination thereof. In one or more embodiments, a threadless float assembly as discussed above may hold pressure from a fluid from either a first end of the casing segment or a second end of the casing segment. A fluid may comprise, mud, cement, a hydrocarbon (for example, oil, gas or both), water, or any combination thereof.

In one or more embodiments, a threadless float assembly comprises a casing segment, a mandrel disposed within the casing segment, a stopper disposed about the mandrel, a packer assembly disposed about the mandrel and coupled to the stopper, a valve assembly coupled to the mandrel and wherein the casing segment couples to a setting tool at a first end of the casing segment during setting of the packer assembly, and wherein the stopper prevents displacement of the packer assembly during setting of the packer assembly. In one or more embodiments, the threadless float assembly further comprises a lock ring disposed circumferentially about the mandrel, wherein the lock ring engages the stopper to secure the mandrel when the packer assembly is in a set position. In one or more embodiments, the valve assembly is disposed between the mandrel and the first end of the casing segment. In one or more embodiments, the threadless float assembly further comprises a removable holder disposed about the valve assembly, wherein the removable holder prevents displacement of the packer assembly during setting of the packer assembly. In one or more embodiments, the valve assembly is disposed at a second end of the casing segment. In one or more embodiments, the threadless float assembly further comprises a removable holder coupled to the mandrel at the first end of the casing segment. In one or more embodiments, a threadless float assembly further comprises one or more shearable holder fasteners, wherein the one or more shearable holder fasteners couple the removable holder to the mandrel. In one or more embodiments, the mandrel comprises one or more threads, wherein the one or more threads mate the valve assembly with the mandrel.

In one or more embodiments, a method for setting a packer assembly of a threadless float assembly comprises disposed in a casing segment comprises disposing a mandrel within the casing segment, disposing a packer assembly about the mandrel, coupling a valve assembly to the mandrel at a first end of the casing segment, coupling a setting tool to the first end of the casing segment, setting the packer assembly using the setting tool and removing the setting tool. In one or more embodiments, the method further comprises disposing a lock ring circumferentially about the mandrel, wherein the lock ring engages the stopper to secure the mandrel when the packer assembly is in a set position. In one or more embodiments, the method further comprises disposing a lock ring circumferentially about the mandrel, wherein the lock ring engages the stopper to secure the mandrel when the packer assembly is in a set position. In one or more embodiments, the method further comprises disposing a removable holder about the valve assembly, wherein the removable holder is coupled to the mandrel, and wherein the holder and the valve assembly are disposed at the first end of the casing segment. In one or more embodiments, the method further comprises coupling a removable holder to the mandrel at a first end of the casing segment, wherein the valve assembly is disposed at a second end of the casing segment, and wherein the removable holder prevents displacement of the packer assembly during setting of the packer assembly and removing the removable holder after setting the packer assembly. In one or more embodiments, coupling the removable holder to the mandrel comprises using one or more shearable holder fasteners to couple the removable holder to the mandrel. In one or more embodiments, the packer assembly is set and the setting tool is removed prior to coupling the valve assembly. In one or more embodiments, the method further comprises disposing a spacer circumferentially about the mandrel between the packer assembly and the first end of the casing segment after setting the packer assembly, wherein the valve assembly is coupled to the mandrel after disposing the spacer, and wherein the spacer is between the packer assembly and the valve assembly.

In one or more embodiments, a method for assembling a threadless float assembly in a casing segment comprises disposing a mandrel within the casing segment, disposing a packer assembly about the mandrel, coupling a removable holder to the mandrel at a first end of the casing segment, wherein the removable holder prevents displacement of the packer assembly during setting of the packer assembly, setting the packer assembly using a setting tool and removing the removable holder. In one or more embodiments, the method further comprises disposing a spacer circumferentially about the mandrel between the packer assembly and the first end of the casing segment, wherein the spacer prevents displacement of the packer assembly after setting the packer assembly and coupling a valve assembly to the mandrel between the spacer and the first end of the casing segment. In one or more embodiments, the method further comprises coupling a valve assembly to the mandrel between a second end of the casing segment and the packer assembly. In one or more embodiments, the removable holder is coupled to the mandrel using a shearable holder fastener.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A threadless float assembly, comprising:

a casing segment;

a mandrel disposed within the casing segment;

a packer assembly disposed about the mandrel and including a stopper disposed about the mandrel towards a first end of the casing segment;

a valve assembly coupled to the mandrel and disposed between the mandrel and the first end of the casing segment;

a removable holder disposed about the valve assembly; and a setting tool coupled to the casing segment at the first end of the casing segment during setting of the packer assembly, wherein the removable holder prevents displacement of the packer assembly during setting of the packer assembly.

2. The threadless float assembly of claim 1, further comprising:

a lock ring disposed circumferentially about the mandrel, wherein the lock ring engages the stopper to secure the mandrel when the packer assembly is in a set position.

3. The threadless float assembly of claim 1, wherein the mandrel comprises one or more threads, wherein the one or more threads mate the valve assembly with the mandrel.

4. The threadless float assembly of claim 1, further comprising:

one or more mandrel fasteners, wherein the one or more mandrel fasteners couple the valve assembly to the mandrel.

5. A threadless float assembly, comprising:

a casing segment;

a mandrel disposed within the casing segment;

a packer assembly disposed about the mandrel including a stopper disposed about the mandrel towards a first end of the casing segment;

a valve assembly coupled to the mandrel and disposed at a second end of the casing segment;

a removable holder coupled to the mandrel at the first end of the casing segment; and a setting tool coupled to the casing segment at the first end of the casing segment during setting of the packer assembly, wherein the removable holder prevents displacement of the packer assembly during setting of the packer assembly.

6. The threadless float assembly of claim 5, further comprising:

one or more shearable holder fasteners, wherein the one or more shearable holder fasteners couple the removable holder to the mandrel.

7. A method for setting a packer assembly of a threadless float assembly disposed in a casing segment, comprising:

disposing a mandrel within the casing segment;

disposing a packer assembly about the mandrel, wherein the packer assembly includes a stopper disposed about the mandrel towards a first end of the casing segment;

coupling a valve assembly to the mandrel disposed between the mandrel and the first end of the casing segment;

disposing a removable holder about the valve assembly;

coupling a setting tool to the first end of the casing segment;

setting the packer assembly using the setting tool, wherein the removable holder prevents displacement of the packer assembly during the setting of the packer assembly; and removing the setting tool.

8. The method of claim 7, further comprising:

disposing a lock ring circumferentially about the mandrel, wherein the lock ring engages the stopper to secure the mandrel when the packer assembly is in a set position.

9. The method of claim 7, wherein the packer assembly is set and the setting tool is removed prior to coupling the valve assembly.

10. A method for setting a packer assembly of a threadless float assembly disposed in a casing segment, comprising:

disposing a mandrel within the casing segment;

disposing a packer assembly about the mandrel;

coupling a valve assembly to the mandrel at a second end of the casing segment coupling a removable holder to the mandrel at a first end of the casing segment, coupling a setting tool to the first end of the casing segment;

setting the packer assembly using the setting tool, wherein the removable holder prevents displacement of the packer assembly during setting of the packer assembly;

removing the setting tool; and removing the removable holder after setting the packer assembly.

11. The method of claim 10, wherein coupling the removable holder to the mandrel comprises using one or more shearable holder fasteners to couple the removable holder to the mandrel.

12. A method for assembling a threadless float assembly in a casing segment, comprising:

disposing a mandrel within the casing segment;

disposing a packer assembly about the mandrel;

coupling a removable holder to the mandrel at a first end of the casing segment, wherein the removable holder prevents displacement of the packer assembly during setting of the packer assembly;

setting the packer assembly using a setting tool;

removing the removable holder;

disposing a spacer circumferentially about the mandrel between the packer assembly and the first end of the casing segment, wherein the spacer prevents displacement of the packer assembly after setting the packer assembly; and coupling a valve assembly to the mandrel between the spacer and the first end of the casing segment.

13. The method of claim 12, wherein:

the spacer is disposed circumferentially about the mandrel between the packer assembly and the first end of the casing segment after setting the packer assembly, and wherein the valve assembly is coupled to the mandrel after disposing the spacer.

14. The method of claim 12, further comprising:

coupling a valve assembly to the mandrel between a second end of the casing segment and the packer assembly.

15. The method of claim 12, wherein the removable holder is coupled to the mandrel using a shearable holder fastener.

* * * * *